US005768913A

United States Patent [19]

McCue, Jr. et al.

[11] Patent Number: 5,768,913

[45] Date of Patent: Jun. 23, 1998

[54] PROCESS BASED MIXED REFRIGERANTS FOR ETHYLENE PLANTS

[75] Inventors: Richard H. McCue, Jr.; Mark Whitney, both of Houston; John L. Pickering, Jr., Kingwood; David Chen, Sugar Land, all of Tex.

[73] Assignee: Stone & Webster Engineering Corp., Boston, Mass.

[21] Appl. No.: 843,448

[22] Filed: Apr. 16, 1997

[51] Int. Cl.[6] ..... F25J 3/02

[52] U.S. Cl. ..... 62/625; 62/627; 62/630

[58] Field of Search ..... 62/625, 627, 630

[56] References Cited

U.S. PATENT DOCUMENTS

| | | | |
|---|---|---|---|
| 2,214,790 | 9/1940 | Greenewalt | 62/175.5 |
| 2,582,068 | 1/1952 | Roberts | 62/123 |
| 3,186,182 | 6/1965 | Grossman et al. | 62/26 |
| 3,444,696 | 5/1969 | Geddes et al. | 62/28 |
| 3,555,836 | 1/1971 | Schramm | 62/9 |
| 4,002,042 | 1/1977 | Pryor et al. | 62/28 |
| 4,203,742 | 5/1980 | Agnihotri | 62/24 |
| 4,270,939 | 6/1981 | Rowles et al. | 62/22 |
| 4,270,940 | 6/1981 | Rowles et al. | 62/28 |
| 4,519,825 | 5/1985 | Bernhard et al. | 62/28 |
| 4,525,187 | 6/1985 | Woodward et al. | 62/31 |
| 4,664,687 | 5/1987 | Bauer | 62/29 |
| 4,759,786 | 7/1988 | Atkinson et al. | 62/630 |
| 4,895,584 | 1/1990 | Buck et al. | 62/29 |
| 4,900,347 | 2/1990 | McCue, Jr. et al. | 62/24 |
| 5,035,732 | 7/1991 | McCue, Jr. et al. | 62/24 |

FOREIGN PATENT DOCUMENTS

013744A2 4/1985 European Pat. Off. .

*Primary Examiner*—Ronald C. Capossela

*Attorney, Agent, or Firm*—Hedman, Gibson & Costigan, P.C.

[57] ABSTRACT

A process and system for providing cooling service (refrigerant) for a gas separation process wherein the refrigerant is obtained from the system process fluid and after serving as refrigerant is returned to the process side for separation into product.

16 Claims, 2 Drawing Sheets

PROCESS BASED MIXED REFRIGERANTS FOR ETHYLENE PLANTS

BACKGROUND OF THE INVENTION

The present invention relates to improvements in providing cooling service for process plants. More specifically, the invention relates to improvements in cold fractionation of light gases.

Cryogenic technology has been employed on a large scale for recovering gaseous hydrocarbon components, such as $C_1$–$C_2$ alkanes and alkenes from diverse sources, including natural gas, petroleum refining, coal and other fossil fuels. Separation of high purity ethylene and propylene from other gaseous components of cracked hydrocarbon effluent streams has become a major source of chemical feedstocks for the plastics industry. Polymer grade ethylenes, usually containing less than 1 percent of other materials, can be obtained from numerous industrial process streams. Thermal cracking and hydrocracking of hydrocarbons are employed widely in the refining of petroleum and utilization of $C_2$+ condensible wet gas from natural gas or the like. Low cost hydrocarbons are typically cracked at high temperature to yield a slate of valuable products, such as pyrolysis gasoline, lower olefins and LPG, along with byproduct methane and hydrogen. Conventional separation techniques performed at or near ambient temperature and pressure can recover many cracked effluent components by sequential liquefaction, distillation, sorption, etc. However, separating methane and hydrogen from the more valuable $C_2$+ aliphatic components, especially ethane and ethene, requires relatively expensive equipment and processing energy.

As recognized in U.S. Pat. No. 5,035,732 (McCue Jr.) the use of demethanizers to facilitate separation of light gases requires a very large supply of ultra low temperature refrigerants and special construction materials to provide adequate separation of $C_1$–$C_2$ binary mixtures or more complex compositions.

Further, it was recognized that a chilling train using plural dephlegmators in sequential arrangement in combination with a multi-zone demethanizer fractionation system requires several sources of low temperature refrigerants. Since suitable refrigerant fluids are readily available in a typical petrochemical facility, the preferred moderately low temperature external refrigeration loop is a closed cycle propylene system ($C_3R$) which has a chilling temperature down to about 235° K. (−37° F.).

It has been found economical to use a propylene loop refrigerant ($C_3R$) due to the relative power requirements for compression, condensation and evaporation of this refrigerant and also in view of the materials of construction which can be employed in the equipment. Low temperature carbon steel can be used in constructing the primary demethanizer column and related reflux equipment. The $C_3R$ refrigerant is a convenient source of energy for reboiling bottoms in the primary and secondary demethanizer zones, with relatively colder propylene being recovered from the secondary reboiler unit. By contrast, the preferred ultra low temperature external refrigeration loop is a closed cycle ethylene system ($C_2R$), which has a chilling temperature down to about 172° K. (−150° F.), requires a very low temperature condenser unit and expensive Cr-Ni steel alloys for safe construction materials at such ultra low temperature. By segregating the temperature and material requirements for ultra low temperature secondary demethanization, the more expensive unit operation is kept smaller in scale, thereby achieving significant economy in the overall cost of cryogenic separation. The initial stages of the chilling train can use conventional closed refrigerant systems, cold ethylene product, or cold ethane separated from the ethane product which is advantageously passed in heat exchange with feedstock gas in the primary rectification unit to recover heat therefrom. For optimum ethylene recovery, temperatures colder than available by ethylene refrigeration must be employed. Typically, turbo expanders or methane liquid obtained from the demethanizer overheads provides this colder duty. Recent developments have shown that an open loop or a closed loop mixed refrigerant system could be employed in place of the ethylene refrigerant system and could also accommodate all the duty requirements at temperatures colder than the lowest level of ethylene refrigerants.

Light contaminants in an ethylene refrigeration or mixed refrigerant system can add substantially to operating costs by causing constant venting from the system and replacement of refrigerant. Even small leaks can cause unscheduled shut downs since light components can raise the condensing pressure at a constant temperature beyond the capabilities of the refrigeration compressor.

Heavy contaminants in an ethylene refrigeration or mixed refrigerant system can also add substantially to operating costs by causing constant draining from the system and replacement of refrigerant. Heavy contaminants raise the refrigerant boiling point and thus reduce effectiveness of the system. Heavy refrigerants stay in the closed loop refrigeration systems and concentrate in the coldest users, adding to operating costs.

It would therefore represent a notable advance in the state of art if a means could be provided which overcame the aforementioned drawbacks of the conventional ethylene and mixed refrigeration systems. The present inventors have described a process employing an internally generated mixed composition process stream as the refrigerant source to achieve these objectives.

SUMMARY OF THE INVENTION

It is an object of the present invention to reduce the energy requirements by matching temperature-duty curves of refrigeration users with the temperature-duty curves of the refrigerant.

It is a further object of the invention to reduce the number of pieces of equipment and the size and/or number of compressors needed for separation of light gases in ethylene plants.

It is another object of the present invention to improve the control of the refrigerant composition and performance in an ethylene processing plant.

To this end, an improved process is provided in which an internally generated process fluid is used as a refrigerant. A mixed liquid stream is taken from within the process, cooled by means such as a sub-cooler and throttling valves and delivered to a location within the system wherein cooling service is required. After the cooling function has been provided the stream is returned to the process side of the system for fractionation. The system also includes means such as a suction drum to obtain rectification of the stream after it has partially vaporized in the cooling function but before return to the process side of the system for fractionation.

DESCRIPTION OF THE DRAWINGS

The drawings are schematics of the improved process of the present invention that will enable a better understanding of the invention when reviewed with the description of the Preferred Embodiment.

DESCRIPTION OF THE PREFERRED EMBODIMENT

Although the subject invention has application and utility in a variety of environments, the preferred embodiment herein is described in a process for cold fractionation of light gases now commonly identified as the ARS (Advanced Recovery System) process of Stone & Webster Engineering Corp. and described in U.S. Pat. Nos.: 4,900,347; 5,035,732; and 5,414,170.

Figure 1:
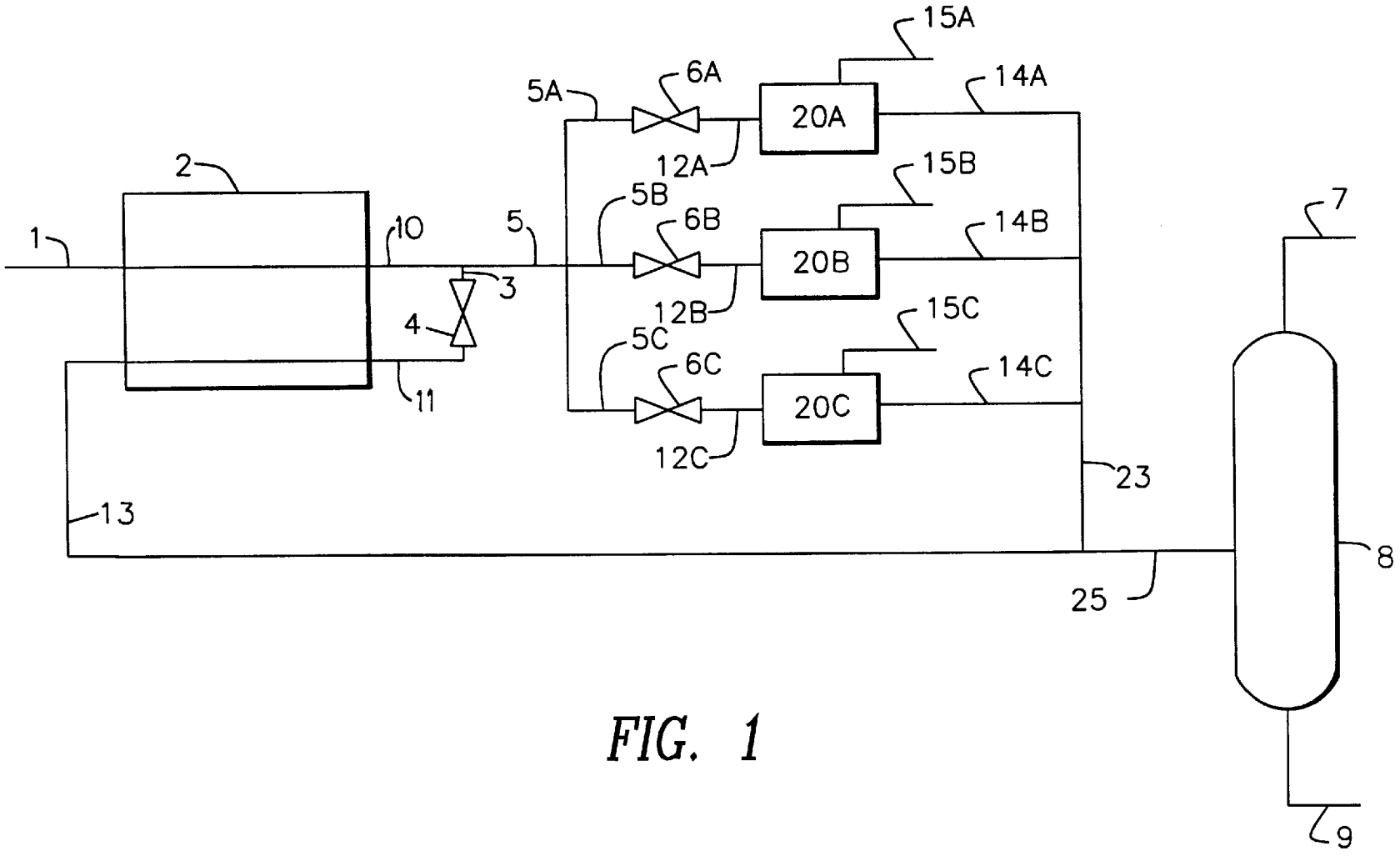
FIG. 1 is a schematic illustration of the process of the present invention.

In FIG. 1, a mixed component liquid process stream is withdrawn from the olefin purification process in a line 1 and cooled in a sub-cooler 2. The cooled liquid from the sub-cooler 2 is withdrawn via a line 10 and separated into two lines 3 and 5 respectively. The liquid in line 5 may then be branched into three branches 5A, 5B and 5C respectively. Each of these branches is then further cooled in the throttling valves 6A, 6B and 6C respectively. The throttled liquids are then employed in a plurality of downstream refrigerant users 20A, 20B and 20C wherein they are partially vaporized. The partially vaporized streams issuing from the downstream refrigerant user in lines 14A, 14B and 14C respectively are combined into a line 23.

The second line from the cooled liquid issuing from the sub-cooler 2 in a line 3 is further cooled by throttling in throttling valve 4 to produce a throttled liquid in a line 11. The throttled liquid in the line 11 is then employed in the cold side of sub-cooler 2 and issues in a line 13. The line 13 is then combined with the line 23 in a line 25.

The combined line 25 is then separated in a separator 8 into a vapor fraction 7 and a liquid fraction 9. The liquid fraction in the line 9 may then be returned as process liquid to any desired downstream fractionator. The vapor fraction in the line 7 may be recycled directly to the cracked gas compressor for the olefins purification system, recycled directly to a downstream fractionator operating at a pressure lower than the pressure of the vapor fractionator, and/or first compressed and then recycled to a downstream fractionator operating at a higher pressure than the pressure of the vapor fraction.

Additionally, the throttled liquids may undergo one or more stages of rectification during the partial vaporization occurring in the downstream refrigerant user, producing both a light vapor in lines 15*a,* 15*b* and 15*c* respectively and a heavier liquid in lines 14*a,* 14*b* and 14*c* respectively. In this case, separated vapor streams are combined and utilized as described herein. In a similar fashion the separated liquid stream can be combined and also utilized as described herein.

Figure 2:
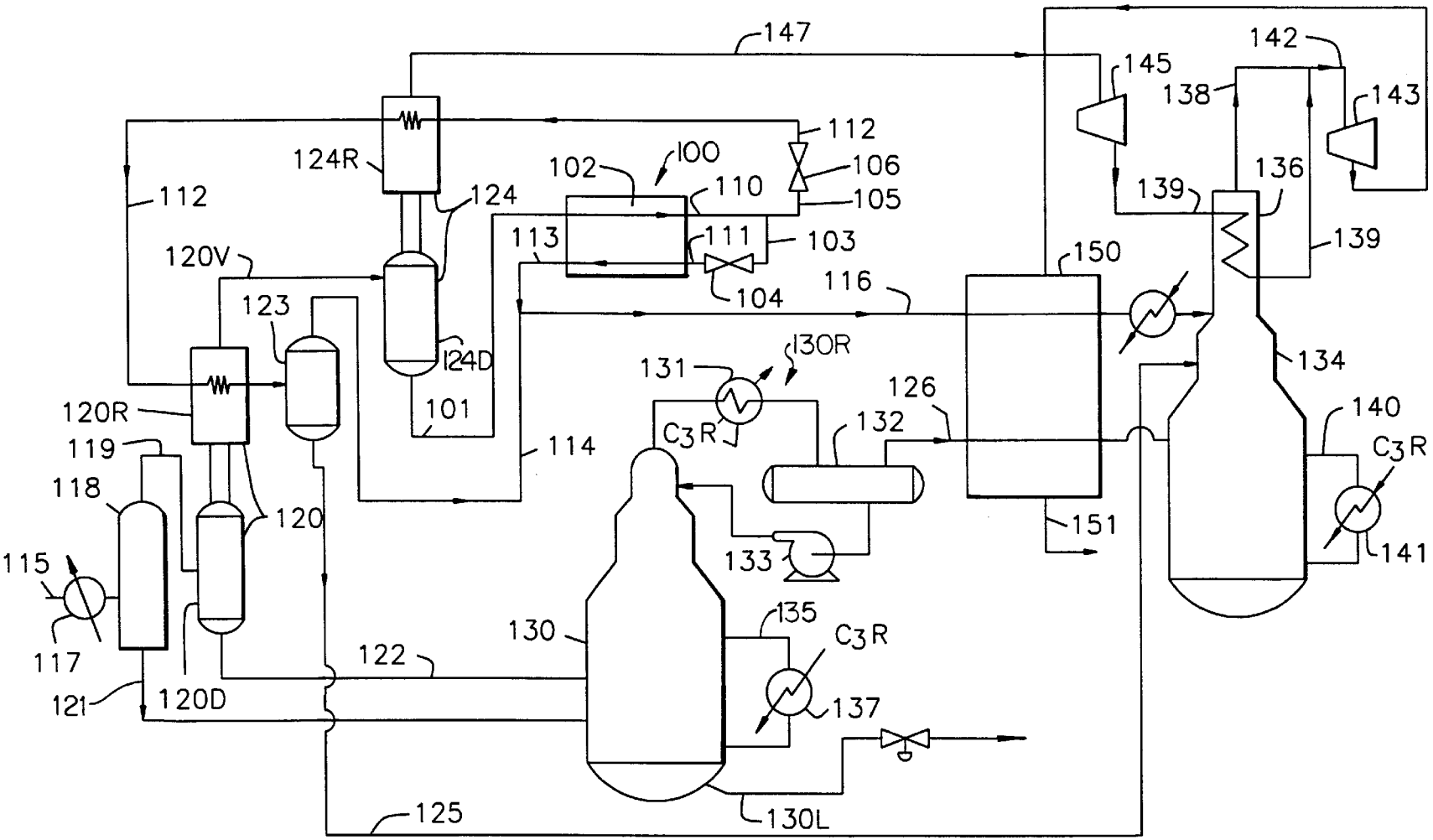
FIG. 2 is a specific application of the process of the present invention in the ARS (Advanced Recovery System) environment.

As seen in FIG. 2, the ARS process relies on serially connected low temperature fractionating sections comprised essentially of dephlegmators and demethanizers. Dephlegmators 120 and 124 are arranged in series with a primary demethanizer 130 and a secondary demethanizer 134.

The coolant sub-assembly 100 is shown in association with a separator drum 123 located downstream of the dephlegmator 124.

The dephlegmator 120 comprises rectification section 120R through which cold side coolant coils pass and a drum section 120D. The dephlegmator 124 is similarly configured with a rectification section 124R and a drum section 124D. Coolant coils extend through the rectification section 124R.

The primary demethanizer 130 includes a vapor reflux system 130R comprised of a heat exchanger 131, drum 132 and pump 133 and also a bottom reboiler in which a reboil line 135 passes through a reboiler 137.

The secondary low pressure demethanizer 134 includes an indirect heat exchanger 136; the hot side through which vapor flows and exits through a line 138. The cold side from the heat exchanger 136 passes through a line 139 into a common line 142 with the overhead vapor from the demethanizer 134 for delivery to an expander 143. The secondary demethanizer 134 also includes a reboil line 140 and reboiler 141. The system also includes an expander 145 through which overhead from the dephlegmator 124 passes through a line 147.

System coolant is obtained in part from the sub-system 100 comprised essentially of a sub-cooler 102, throttling valves 104 and 106.

In addition a refrigeration unit 150 operating as an indirect heat exchanger is provided to cool the discharge from the sub-cooler 102 and overhead from the primary demethanizer 130 before delivery of both streams to the secondary demethanizer 134.

The process proceeds by delivery through line 115 of cracked effluent from a cracking furnace through a cracked gas compressor and a heat exchanger 117 wherein the cracked effluent is at least partially condensed to the separation drum 118. Vapor overhead from the separation drum is delivered through a line 119 to the dephlegmator 120. Bottoms from the separation tank 118 are delivered to the primary demethanizer 130 through a line 121.

The overhead from the dephlegmator 120 is sent through line 120V to the dephlegmator 124. The bottoms from the dephlegmator 124 is taken for treatment to provide coolant for the system and for ultimate fractionation into the product. The bottoms from the dephlegmator 124 passes through a line 101 to the sub-cooler 102 wherein the temperature of the stream is reduced to a temperature at which no significant flashing will occur when the stream is throttled downstream as described below, i.e., on the order of about 20° C. The stream 110 leaving the sub-cooler 102 separates into two branches 103 and 105. The stream passing through branch line 103 is further cooled by about 4° to 5° C. in the throttling valve 104 by reducing the pressure of the stream without any significant flashing and returned to the cold side of the sub-cooler 102 through a line 111. After serving as coolant in the sub-cooler 102 the heated fluid is delivered through a line 113 with overhead from the drum 123 in a line 114 to a common line 116 to the refrigeration unit 150. The fluid passing through the branch line 105 is also cooled by about 4° to 5° C. by passage through the throttling valve 106, but is delivered directly through a line 112 to the dephlegmator rectification zone 124R to serve as a source of indirect cooling. After discharge from the rectification zone 124R, the heated and partially vaporized fluid is delivered to the rectification zone 120R to serve as a source of indirect coolant and then to suction drum 123. The overhead from the drum 123 is sent through line 114 to common line 116. The bottoms from the drum 123 is sent directly to the secondary demethanizer 134 through a line 125.

The overhead from the dephlegmator 124 is sent through a line 147 to the expander 145 and cooled, after which it passes through a line 139 to serve as indirect coolant in the heat exchanger 136. After expansion in the expander 143 the overhead from the secondary demethanizer 134 and the heat exchange coolant from the heat exchanger 136 are sent to the refrigeration unit 150. The stream 116 from the sub-cooler system 100 and the overhead in line 126 from the primary demethanizer 130 are cooled in the refrigeration unit 150 and then delivered to the secondary demethanizer 134. The discharge from the cold side of the refrigeration unit 150 is sent downstream through a line 151 to be processed as fuel.

The basic separation process to separate the light gases proceeds generally as described in U.S. Pat. No. 5,035,732 which is incorporated herein by reference.

Although the sub-assembly 100 has been shown in the preferred embodiment in association with the dephlegmator 120, similarly configured sub-assemblies 100 can be arranged in association with various other components. One or more mixed liquid streams from either dephlegmators 120, 124 or demethanizers 130, 134 can be treated by the system of sub-assembly 100 to serve as coolant at various other points in the process and returned to the process side of the system for fractionation.

A prophetic example of the process of the present invention is shown in the following table:

| Reference Line From FIG. 1 | 1 | 10 | 5 | 12 (12A, 12B, 12C) | 23 | 3 | 11 | 13 |
|---|---|---|---|---|---|---|---|---|
| Temp °F. | −82.2 | −101.12 | −101.12 | −105.68 | −63.77 | −101.1 | −105.7 | 84.9 |
| P kg/cm$_2$ | 34.34 | 34.20 | 34.20 | 10.55 | 10.41 | 34.20 | 10.55 | 10.41 |
| COMPOSITION | | | | | | | | |
| $H_2O$ | 0.00 | 0.00 | 0.00 | 0.00 | 0.00 | 0.00 | 0.00 | 0.00 |
| Hydrogen | 7.35 | 7.35 | 4.44 | 4.44 | 4.44 | 2.91 | 2.91 | 2.91 |
| Methane | 147.44 | 147.44 | 89.10 | 89.10 | 89.10 | 58.34 | 58.34 | 58.34 |
| Acetylene | 2.78 | 2.78 | 1.68 | 1.68 | 1.68 | 1.10 | 1.10 | 1.10 |
| Ethylene | 264.64 | 264.64 | 159.93 | 159.93 | 159.93 | 104.71 | 104.71 | 104.71 |
| Ethane | 7.69 | 7.69 | 4.65 | 4.65 | 4.65 | 3.04 | 3.04 | 3.04 |
| CO | 0.11 | 0.11 | 0.07 | 0.07 | 0.07 | 0.04 | 0.04 | 0.04 |
| $N_2$ | 0.14 | 0.14 | 0.08 | 0.08 | 0.08 | 0.06 | 0.06 | 0.06 |
| TOTAL RATE | 430.14 | 430.14 | 259.95 | 259.95 | 259.95 | 170.20 | 170.20 | 170.20 |

We claim:

1. A process for the production of refrigerant for a process to separate gases from a product stream comprising the steps of:

withdrawing a stream of process fluid from the separation process;

cooling said withdrawn stream of process fluid to a temperature below the operating temperature of a downstream process fluid refrigerant user;

cooling said downstream process fluid refrigerant user with said cooled withdrawn stream whereby said cooled withdrawn stream is at least partially vaporized; and returning said at least partially vaporized stream to said separation process.

2. A process as in claim 1 wherein the step of cooling said withdrawn stream of process fluid comprises the steps of indirectly contacting said withdrawn stream of process fluid in a sub-cooler with a colder stream of fluid to reduce the temperature of said withdrawn stream of process fluid and reducing the pressure of the sub-cooled withdrawn stream of process fluid to further reduce the temperature of the withdrawn process fluid.

3. A process as in claim 2 wherein the pressure of the sub-cooled withdrawn stream is reduced in a throttling means.

4. A process as in claim 3 further comprising the steps of branching the withdrawn stream of process fluid exiting the sub-cooler into at least two branches; passing a first branch through a pressure reducing means to reduce the temperature of the withdrawn stream of process fluid; and employing said reduced pressure first branch as said colder stream of fluid in said sub-cooler.

5. A process as in claim 4 wherein a second branch of the withdrawn stream of process fluid is passed through a pressure reducing means to further reduce the temperature of said second branch and comprises the cooled withdrawn stream for said downstream process fluid refrigerant user.

6. A process as in claim 5 wherein the temperature of the withdrawn stream of process fluid is reduced by about 20° C. during passage through said sub-cooler, and said branched streams are further reduced by about 4° to 5° C. during passage through said pressure reducing means.

7. A process as defined in claim 1 wherein said process to separate gases from a product stream comprises an olefins purification process having a demethanizer chilling train.

8. A process as in claim 7 wherein said stream of process fluid withdrawn from the separation process comprises a cold process liquid from said demethanizer chilling train.

9. A process as in claim 7 wherein within said demethanizer chilling train the steps occur of partially condensing the feed to the demethanizer chilling train, separating said partially condensed demethanizer chilling train feed in a separation drum into a first vapor fraction and a first liquid fraction; separating said first vapor fraction in a first dephlegmator into a second vapor fraction and a second liquid fraction; separating said second vapor fraction in a second dephlegmator into a third vapor fraction and a third liquid fraction; separating said second liquid fraction, and said third liquid fraction in a first demethanizer to produce a fifth vapor fraction and a fifth liquid fraction wherein said withdrawn stream of process fluid comprises at least a portion of one or more of said first liquid fraction, said second liquid fraction, said third liquid fraction, said fourth liquid fraction and/or said fifth liquid fraction.

10. A process as in claim 9 wherein said vapor fraction from said second dephlegmator is cooled in expander and passed in indirect heat exchange relationship with the vapor fraction from the second demethanizer, then combined with said vapor fraction from the second demethanizer, passed through an expander and sent through a refrigeration unit to indirectly cool the discharge from the sub-cooler and the overhead from the first demethanizer prior to delivery of the cooled streams to the second demethanizer.

11. A process as in claim 9 wherein said downstream process fluid refrigerant user comprises one or more of said first dephlegmator, said second dephlegmator, a condenser means for said first demethanizer, and/or a condenser means for a second demethanizer.

12. A process as in claim 1 wherein said partial vaporization comprises more than one stage of rectification.

13. A system for providing refrigerant used with a process to fractionate hydrocarbons comprising:

a sub-cooler for cooling a portion of the fluid being processed;

a throttling valve downstream of the sub-cooler to further cool the cooled portion of the fluid discharged from the hot side of said sub-cooler thus producing cold system refrigerant;

means for delivering the cold system refrigerant fluid exiting from said throttling valve back to the process at a location requiring refrigerant;

means to vaporize a portion of the cold system refrigerant at the location requiring the system refrigerant; and a line to return the vaporized portion of the fluid to the process side of the process for further fractionation.

14. A system as in claim 13 further comprising a line to return liquid of the system to the process for further fractionation.

15. A system as in claim 13 further comprising a line extending from the exit of the hot side of the sub-cooler; a branch line from said line extending from said sub-cooler hot side line; a throttling valve in said branch line; and a line extending from the throttling valve in said branch line through the cold side of said sub-cooler.

16. A system as in claim 15 further comprising a dephlegmator through which the system refrigerant flows and a demethanizer into which the refrigerant exiting from the dephlegmator is delivered for fractionation.

* * * * *